United States Patent [19]

Dietrich

[11] 4,403,557

[45] Sep. 13, 1983

[54] APPARATUS FOR LETTING OUT FURSKINS

[75] Inventor: Herbert Dietrich, Kaiserslautern, Fed. Rep. of Germany

[73] Assignee: Pfaff Industriemaschinen GmbH, Fed. Rep. of Germany

[21] Appl. No.: 386,307

[22] Filed: Jun. 8, 1982

[30] Foreign Application Priority Data

Jun. 13, 1981 [DE] Fed. Rep. of Germany ..... 3123567

[51] Int. Cl.[3] ..... D05B 15/00; D05B 27/00

[52] U.S. Cl. ..... 112/19; 112/121.15

[58] Field of Search ..... 112/19, 18, 16, 20, 112/2, 121.15, 121.26, 21

[56] References Cited

U.S. PATENT DOCUMENTS

| | | | |
|---|---|---|---|
| 1,383,976 | 7/1921 | Bouton | 112/19 |
| 2,703,541 | 3/1955 | Miller | 112/21 |
| 2,800,095 | 7/1957 | Schramm | 112/21 |
| 2,905,366 | 9/1959 | Shoaf | 112/16 X |
| 3,771,475 | 11/1973 | Guichard | 112/121.15 |
| 4,041,883 | 8/1977 | Meratti | 112/21 |
| 4,066,027 | 1/1978 | Marjorio | 112/121.15 |
| 4,282,820 | 8/1981 | Fenzel | 112/121.15 |

FOREIGN PATENT DOCUMENTS

| | | | |
|---|---|---|---|
| 3122118 | 3/1982 | Fed. Rep. of Germany | 112/16 |
| 936715 | 9/1963 | United Kingdom | 112/20 |

*Primary Examiner*—H. Hampton Hunter

*Attorney, Agent, or Firm*—McGlew and Tuttle

[57] ABSTRACT

An apparatus for use with a sewing machine which has a reciprocating needle which moves in cooperation with a pick to sew materials such as furskins into sections at a sewing zone comprises a carriage which is mounted alongside the machine and is movable through a sewing zone and which is advantageously driven from the sewing machine through a drive means which may be selectively connected to the carriage for moving it. A clamp is employed for clamping the material or the furskin therein which is to be joined from an initial skin portion or section and it is positioned on the carriage for movement with the carriage past the sewing zone for sewing thereof to a previously formed section which is held in a holding bracket which is carried by the carriage for movement therewith through the sewing zone at the same time as the furpiece carried in the clamp.

8 Claims, 8 Drawing Figures

APPARATUS FOR LETTING OUT FURSKINS

FIELD AND BACKGROUND OF THE INVENTION

This invention relates in general to sewing machines and in particular to a new and useful sewing machine for letting out furskins.

An assembly for letting out furskins has been disclosed in German Pat. No. 2 204 399. This prior art design provides a complete automation of the technique of letting out furskins which hitherto was widely a manual operation. The provided assembly comprises a holding mechanism for the furskin, mounted above a supporting table and formed by two clamping jaws which are movable relative to each other lengthwise and transversely. A folding sword and a hair divider are mounted between the clamping jaws. Further provided are a lowerable cutter above the folding sword and a sewing machine abreast of the sword.

In this prior device, the operation of letting out includes the steps of folding the furskin diagonally relative to the longitudial edges of the skin, and separating a part by a cut along the crest of the fold. Thereupon, this part clamped in a jaw is displaced along the cut edge a proper distance back, which is called backspacing and in this new position, it is sewed again to the part wherefrom it was cut. The two clamping jaws are then moved transversely to the cutting direction to make the next cut. The slicing and sewing on continues until the entire furskin is let out.

Since after placing a furskin on the table, all further operations are effected automatically, the result is a uniformly and exactly done work which is in no way affected by the deftness of the operator. Only the equipment for performing the individual operations and controlling the steps in a time sequence is very expensive.

SUMMARY OF THE INVENTION

The present invention is directed to an assembly which can be fed with individual furskin strips cut in advance and makes it possible to move these individual strips, and the section of strips already sewn together, relative to each other and fix them in a position suitable for sewing while holding the fur hairs off the stitching zone.

According to the invention, each individual furskin strip is first brought into its correct position for sewing, whereupon the furskin section already let out is brought into the proper adjacent position. With this sequential positioning of the parts, the operator can concentrate on each of the positioning operations separately, i.e. take care of and correct the motions and ensure that the fur hairs are kept away from the stitching zone. Upon positioning the parts in the clamps or between the clamp and the holding bracket, they are moved along the sewing machine by displacing the carriage, and sewed to each other.

Since the assembly is supplied with individual furskin strips cut in advance, there is no need for a holding sword with a fur hair divider, nor for a cutting device, nor for a transverse motion of the parts to gradually slice the skin. Consequently, the assembly is much simpler in design than the fully automatic prior art machine. As compared to the previous manner of an almost completely manual letting out of furskins, which required particularly dexterous workers, the invention assembly only requires a corresponding care in inserting and positioning the fur skin part and does not require a particular skill, neither for the inserting and positioning nor for the sewing operation, so that even an unskilled worker may operate the machine.

Since separate clamps for the precut strips are employed which can be removed from the carriage, a number of clamps corresponding to the number of furs and placed in a magazine which are removable in succession and transferred to a movable carriage. The carriage can be coupled to the advance drive of the sewing machine. This may advantageously be embodied by omitting the feed elements in a fur sewing machine and providing a gear on the respective shaft journal, meshing with a rack mounted on the carriage.

A development of the invention provides that the clamp comprises a supporting plate and a clamping plate which is pivotable relative thereto in a way such that by pivoting into its clamping position, the clamping plate deflects the fur hairs away from the skin edge which will later be sewed. In addition, shortly before reaching its clamping position, the clamping plate is displaced away from the end close the the needle of the supporting plate, and thus from the skin edge to be sewed, so that the fur hairs are further stretched and reliably held off the sewing area without any urgency on the part of the operator.

Gripping tongs are provided for gripping the furs by the seam allowance and after sewing on the strip, the let-out furskin section is gripped by the last sewing allowance. Upon supplying the carriage with a new clamp and displacing it into its initial position, it is pivoted so that the fur side of the last sewn furskin strip is moved upwardly along the clamping plate of the clamp into the sewing position until the edge of the let-out section applies to the edge of the furskin strip retained in the clamp. Due to the upward motion, the hairs of the last sewn furskin strip are deflected away from the skin edge to be sewn, so that at the let-out section too, the fur hairs are held off the stitching area without any agency on the part of the operator.

The inventive assembly is suitable not only for letting out furskins, but also for the so-called feathering of furs, which is a special form of galooning. Feathering furs means inserting and sewing a leather strip between every two furskin strips, in order to enlarge the fur area or obtain a special effect in fashion. In such a case, it is advisable to insert the furskin and leather strips each in a clamp of its own and to arrange the clamps in the magazine in a sequence needed for the later sewing together of the strips.

Accordingly it is an object of the invention to provide an apparatus for use with a sewing machine which has a reciprocating needle to sew material such as furskins into assembled sections at a sewing zone which comprises a carriage mounted alongside the sewing machine and movable through the sewing zone which driven by drive means and carries a clamp which is used for clamping the material therein in a position for being sewn for moving it through the sewing zone along with an article section which is engaged in a holding bracket carried by the carriage for movement therewith through the sewing zone.

A further object of the invention is to provide a clamping device for clamping articles such as furskins in position for moving them into association with a sewing needle.

A further object of the invention is to provide a gripping tong mechanism for cooperating with a piece of material which is moved in a clamp by a carriage through a sewing zone in order to hold a previously sewn section in the vicinity of the zone.

A further object of the invention is to provide an apparatus for use with a sewing machine which is simple in design, rugged in construction and economical to manufacture.

The various features of novelty which characterize the invention are pointed out with particularity in the claims annexed to and forming a port of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENTS

Figure 1:
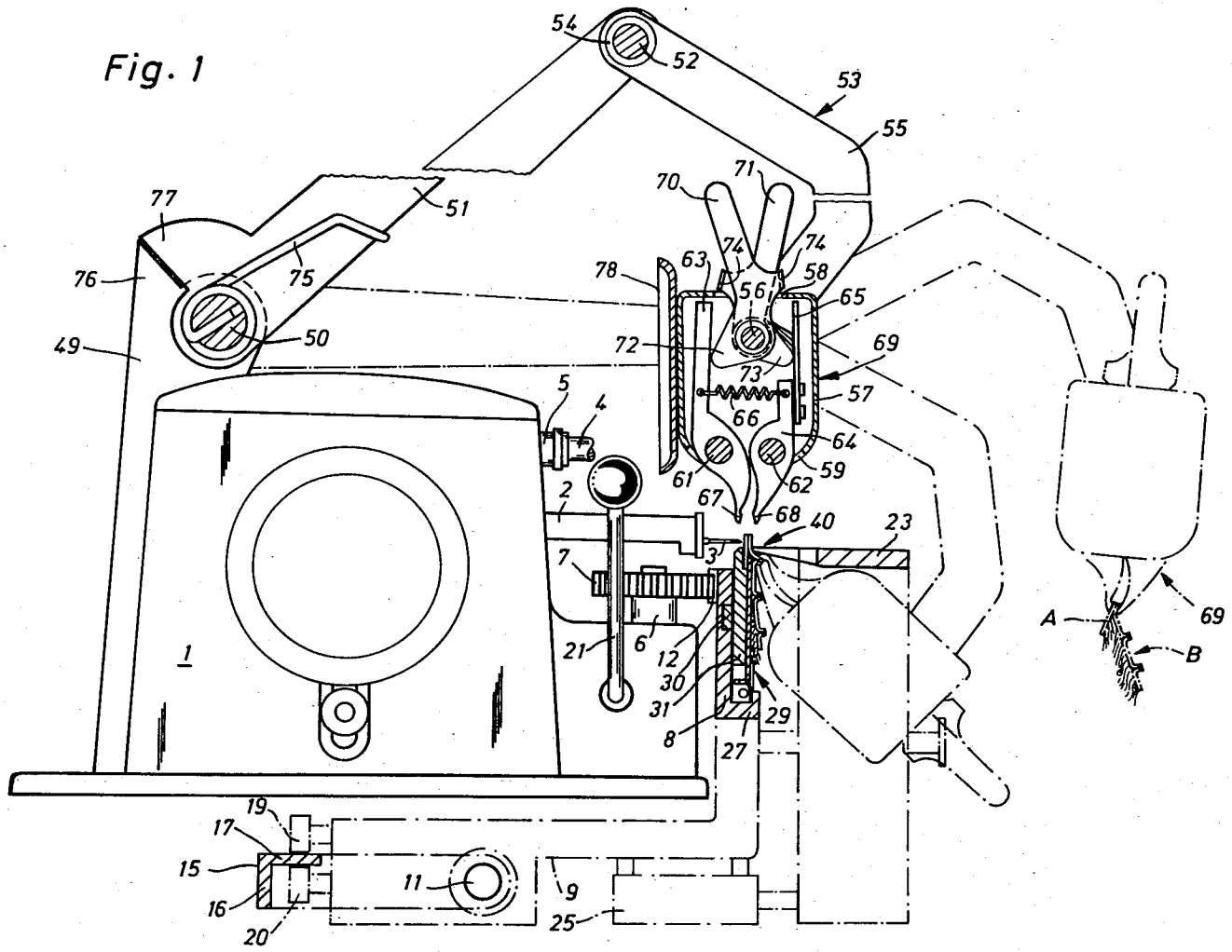
FIG. 1 is a sectional view of an assembly taken along the line I—I of FIG. 2 and indicating gripping tongs constructed in accordance with the invention.

Referring to the drawings in particular the invention embodied therein comprises an apparatus for use with a sewing machine generally designated 1 having a reciprocating needle 3 arranged to sew materials such as furskin portions into larger sections at a sewing zone which comprises a carriage 8 which is mounted alongside the sewing machine 1 and is movable through the sewing zone at the location of the needle 3. Drive means including a gear 7 connected to a shaft 6 driven from the sewing machine main shaft move the carriage through the sewing zone. The carriage 8 defines a support for a clamp 29 for clamping the material therein in a position for being sewn and it moves with the carriage through the sewing zone for the sewing of the material. In addition a holding bracket 23 is provided on the carriage for holding an article section which has already been formed in the vicinity of the clamp 29 which is carried by the carriage for movement therewith through the sewing zone.

A fur sewing machine 1 secured to a frame (not shown) and is equipped with a needle bar 2 movable in a horizontal plane and carrying a needle 3, and a rotary hook 4 (shown only partly) carried on a shaft 5, to produce single thread whipping stitches. To feed the work, conventional fur sewing machines are provided with two dish-shaped wheels rotating in a horizontal plane, of which one is driven and the other idles under pressure.

In the fur sewing machine 1 employed for applying the invention, the feed wheels are removed. Instead of the driven feed wheel, a gear 7 is secured to shaft journal 6 which is intermittently driven by means of a ratchet mechanism (not shown) in accordance with the motion of needle bar 2. The idling feed wheel is replaced by an elongated carriage 8 which is designed with two crosswise projecting arms 9 on its ends. The two arms 9 carry each a bearing bushing 10. By means of bushings 10, carriage 8 is mounted for displacement on a fixed, horizontally extending slide rod 11. Carriage 8 is equipped with a rack 12 meshing with gear 7. Slide rod 11 is supported in a U-frame 13 which is secured to the machine frame and comprises two supporting arms 14 and a connecring bar 15 extending parallel to rod 11. Bar 15 has an L cross-section including a vertical leg 16 and a horizontal leg 17. Secured to carriage 8 are two studs 18, each carrying a roller 19, 20 respectively. The upper roller 19 applies to the upper side of leg 17, the lower roller 20 to the underside thereof. Fur sewing machine 1 is further equipped with a handle 21 with which the ratchet mechanism (not shown) driving shaft 6 can be manually disengaged.

Two guide rods 22 are secured to the carriage 8, which extend horizontally, transversely to the lengthwise extension thereof and carry a laterally projecting holding bracket 23 displaceable on the rods. The side facing carriage 8 of holding bracket 23 is tapered and forms a clamping face 24. The piston rod 26 of an air cylinder 25 secured to carriage 8 is connected to holding bracket 23.

Carriage 8 is designed with a lateral extension 27 forming an upwardly open recess 28. An elongated clamp 29 can be inserted into recess 28. Clamp 29 is held in place by means of a magnet 30 which is secured to carriage 8.

As shown best in FIGS. 3 to 8, clamp 29 comprises a supporting plate 31 and a flat clamping plate 32. Supporting plate 31 is provided with an elongated shallow recess 33 reaching from the upper edge of the plate 3/mm downwardly. To either end of supporting plate 31, a side plate 34 is secured. Side plates 34 project both below the underside and above the top of supporting plate 31 and are provided with an extension 35 on their lower ends and an extension 36 on their upper ends. Clamping plate 32 has substantially the same vertical extension as supporting plate 31 but is slightly shorter horizontally so that there is some play toward side plates 34. The lower end of clamping plate 32 is angled, to increase the rigidity in bending. To the side remote from supporting plate 31 of clamping plate 32, two extension pieces 37 are secured which project laterally beyond side plates 34. A leg torsion spring 38 is secured to either of the lower extensions 35. Leg springs 38 apply to extension pieces 37 and extend up to the region of upper extensions 36. A pin 39 extending close above supporting plate 31 is secured to either of side plates 34.

Figure 4:
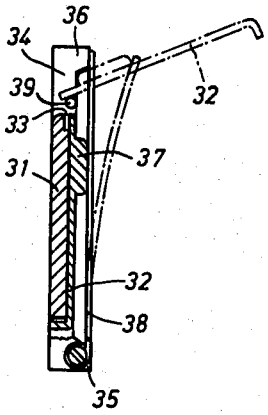
FIG. 4 is a sectional view taken along the line IV—IV of FIG. 3.

Clamping plate 32 in clamping position is held applied to supporting plate 31 solely by leg springs 38. Clamping plate 32 can be moved out of its clamping position into an open position indicated in dot-dash lines in FIG. 4. While pivoting clamping plate 32 into its open position, extension pieces 37 slide and tilt along side plates 34, with leg springs 38 being bent back, as indicated in FIG. 4. At the end of the pivotal motion, extension pieces 37 of clamping plate 32 butt against upper extensions 36, while the end portion of the clamping plate applies against the two pins 39. Pins 39 prevent a further pivoting of clamping plate 32 by leg springs 38 beyond the open position indicated in FIG. 4 in dot-dash lines. While moving clamping plate 32 from its clamping into its open position, and vice versa, the plate performs a substantially pivotal motion about an axis extending in the zone of the upper end of supporting plate 31. With clamp 29 inserted in recess 28 of carriage 8 as shown in FIG. 1, the upper end of supporting plate 31 faces the needle 3 of fur sewing machine 1.

Carriage 8 with clamp 29 inserted in recess 28 thereof, and holding bracket 23 form a holding device 40 for the furskin parts to be sewed to each other.

A magazine 41 for a plurality of clamps 29 is supported on the machine frame above the path of motion of carriage 8. Magazine 41 has two side walls 42, a front wall 43, and a rear wall 44. On the inside of side walls 42, two horizontally extending ledges 45 are provided on which the lower extensions 35 of clamps 29 rest. Ledges 45 end at a location spaced from front wall 43, with the spacing exceeding the thickness of a clamp 29. Supported in rear wall 44 are two horizontally displaceable rods 46 carrying a push plate 47. Two springs 48 surrounding rods 46 urge plate 47 and thus clamps 29 toward fron wall 43 of magazine 41, so that the foremost clamp 29 which is no longer supported by ledges 45 is prevented from dropping by this thrust. With carriage 8 in a position below magazine 41, this foremost clamp 29 is held close above recess 28 of carriage 8.

Two stands 49 are secured to the machine frame, carrying a horizontal rod 50. Two arms 51 are mounted for pivoting on rod 50 and connected to each other by a rod 52. A frame 53 is mounted on rod 52 for displacement and pivoting. Frame 53 comprises a sleeve 54 embracing rod 52, two arms 55 secured to sleeve 54, and a rotatable rod 56 extending between the arms 55. An elongated housing 57 is pivotally mounted on rod 56, having an opening 58 above and opening 59 below. Two rods 61, 62 extending parallel to rod 56 are secured to the two front walls 60 of housing 57. A plate 63 is mounted for pivoting on rod 61, whose horizontal length substantially corresponds to the spacing of front walls 60. The upper end of plate 63 projects upwardly beyind rod 56. The lower end of plate 63 projects from opening 59 and is tapered. A plurality of two armed levers 64 is mounted for pivoting on rod 62. To the upper end of levers 64, leaf springs 65 are secured which extend upwardly beyond rod 56. The lower end of levers 64 is tapered. Tension springs 66 having their other end attached to plate 63 act on the upper end of levers 64.

Plate 63 forms a one-piece jaw 67 while levers 64 form a multi-piece jaw 68. To actuate one-piece jaw 67, a manually operated handle 70 is pivotally mounted on rod 56 and provided on its lower end with a cam 72 contacting plate 63. To actuate multi-piece jaw 68, a manually operated handle 71 is secured to rotatable rod 56. To rod 56, a plurality of cams 73 of equal size is secured corresponding in number to, and bearing against, leaf springs 65. From one end to the other of the row, each cam 73 is angularly offset by a small angle relative to the preceding one. Consequently, upon actuating handle 71, the individual leaf springs 65 and thus levers 64 are moved into their clamping or open positions, respectively, with a delay corresponding to the angular setoff. The force to be applied is smaller with the gradually delayed actuation of leaf springs 65 or levers 64 than with a simultaneous actuation.

Each handle 70, 71 is provided with a stop 74 projecting into the path of motion of the other one of these two handles. Stops 74 produce the effect that jaws 67, 68 can be pivoted by tension springs 66 only until handles 70, 71 butt against the stop 74 of the respective other handle 70, 71.

Two leg springs 75 are secured to rod 50, having one end inserted into a corresponding bore of rod 50 while their other end bears against the associated arm 51. Strands 49 are provided with a stop surface 76. A stop 77 laterally extending in the direction of the associated stop surface 76 is provided on each of arms 51. Cooperating stop surfaces 76 and stops 77 determine the rest position of arms 51. Laterally of fur sewing machine 1, a vertically extending stop plate 78 is provided (supporting means not shown) against which housing 57 of gripping tongs 69 applies when arms 51 are in their rest position. In this rest position of gripping tongs 69 jaws 67, 68 are in open position and extend substantially symmetrically relative to recess 33 of clamp 29 and to clamping plate 32.

The assembly operates as follows:

Treated are parallel furskin strips A which have been cut in advance and have a uniform width of 5 mm, for example. First, strips A are inserted each into a clamp 29 of its own. To facilitate this operation, and with the clamping plate 32 in open position, clamp 29 to be filled is inserted into a receiving plate 79 shown in FIG. 5 which is provided with a recess 80 for receiving supporting plate 31. Recess 80 terminates in a shallower recess 81 having a width of 2 mm, considered from the edge of recess 80. Shallow recess 81 and the 3 mm wide recess 33 of supporting plate 31 form together a shallow, 5 mm wide groove for receiving a furskin strip A.

Figure 5:
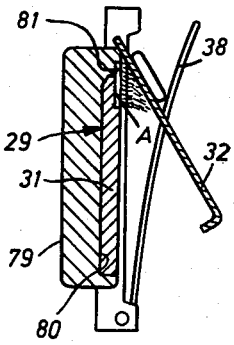
FIG. 5 is a sectional view of the clamp shown in FIG. 4 with an inserted furskin strip.
Figure 6:
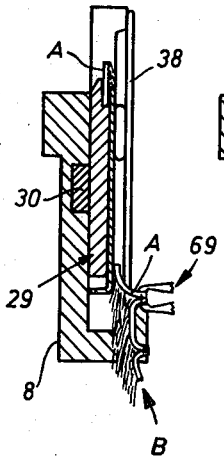
FIGS. 6 to 8 are views similar to FIG. 5 showing sequential phases of the movement of the furskin parts to be sewn together.
Figure 7:
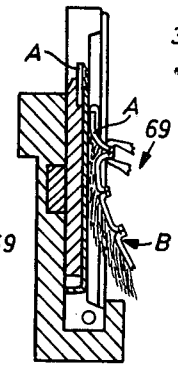
Figure 8:
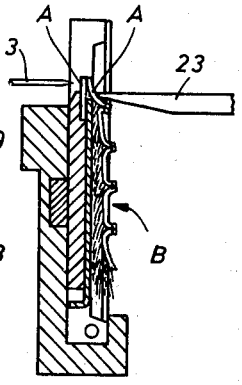

After a strip A has been inserted into recesses 33 and 81, clamping plate 32 is pivoted manually into its clamping position. Since this pivoting is effected about an axis extending into the zone of the upper end of supporting plate 31, and in the downward direction, as indicated in FIG. 5, the fur hairs are deflected away from the upper edge of strip A, which will later be sewed. Shortly before reaching the clamping position, clamping plate 32 is shifted downwardly, as viewed in FIG. 5, and thus away from edge to be sewn of furskin strip A. The fur hairs are thereby additionally stretched and safely kept away from the zone of that edge. In the clamping position, clamping plate 32 is pressed by the two leg springs 38 against strip A which is thereby firmly squeezed between supporting plate 31 and clamping plate 32. As clamping plate 32 has been shifted downwardly, its upper end comes into a position slightly below the upper edge of supporting plate 31.

After clamping furskin strip A in clamp 29, the clamp is removed from receiving plate 79 and inserted into magazine 41. In the same way, all the other strips A sliced from a single furskin are placed in respective clamps 29 and the clamps are inserted in magazine 41.

To transfer a clamp 29 into carriage 8, the carriage must be in a position in which recess 28 of extension 27 is exactly below magazine 41. Now, with holding bracket 23 in its rest position, the foremost clamp 29 is manually pushed downwardly into recess 28. Thereupon, carriage 8 is manually shifted into its mid-position shown in FIG. 2. Thereby, the ratchet mechanism (not shown) provided for driving shaft journal 6 is disengaged, so that gear 7 can rotate freely. At the start of an operation of sewing a series of strips A belonging to a single furskin, gripping tongs 69 have not yet seized any let-out section of the fur. Therefore, a loose skin part must be fed to strip A received in carriage 8. This may be another strip A, or the triangular end piece which is obtained at the start of the diagonal skin slicing. The loose skin part, with the fur side facing clamping plate 32, is manually introduced into the gap between clamp 29 and holding bracket 23, into a position in which the two parts or strips are offset relative to each other by a distance corresponding to the desired extend of letting out of the skin, which distance is called backspacing. The loose skin part is advantageously introduced from below outwardly, during which motion the fur hairs brush along clamping plate 32. In this way, the hairs are deflected downwardly and held away from the upper edge or part of the part or strip to be later sewn. As soon as the upper edge of the loose skin part is aligned with the upper edge of the furskin strip A received in clamp 29, holding bracket 23 is moved into its clamping position by actuating air cylinder 25, whereby at a location above clamp plate 32, the hitherto loose skin part is pressed against strip A.

After this actuation of holding bracket 23, carriage 8 is manually displaced in the direction of fur sewing machine 1. As soon as the front edge of the backspaced skin part reaches the stitching zone, the manual displacement of carriage 8 is stopped. Then, lever 21 is actuated whereby the ratchet mechanism is engaged. Next, fur sewing machine 1 is started, so that furskin strip A is sewed to the skin part held in place by holding bracket 23. During the sewing operation, carriage 8 is intermittently driven by gear 7.

With the sewing operation terminated, fur sewing machine 1 and thus carriage 8 are stopped. Tongs 69, which have been in a rest position above the clamp 29 received in carriage 8, is manually moved downwardly along stop plate 78 until the lower edges of jaws 67, 68 reach the level of the sewn seam. Then, the two handles 70, 71 are pivoted toward each other so that through cams 72, 73, jaws 67, 68 are pivoted into their clamping position to firmly grip the sewn strips by the seam allowance. Thereupon, holding bracket 23 is moved by air cylinder 25 back into its rest position and gear 7 is disengaged from the ratchet mechanism by actuating lever 21. Gripping tongs 69 firmly holding the let-out fur section B formed by furskin strip A and the formerly loose skin part is then moved upwardly by manually pivoting frame 53, so that strip A hitherto still received in clamp 29 is withdrawn from the clamp. The now empty clamp 29 is them removed from recess 28, and carriage 8 is displaced into its receiving position below magazine 41, whereupon a new clamp 29 is inserted into recess 28.

Figure 2:
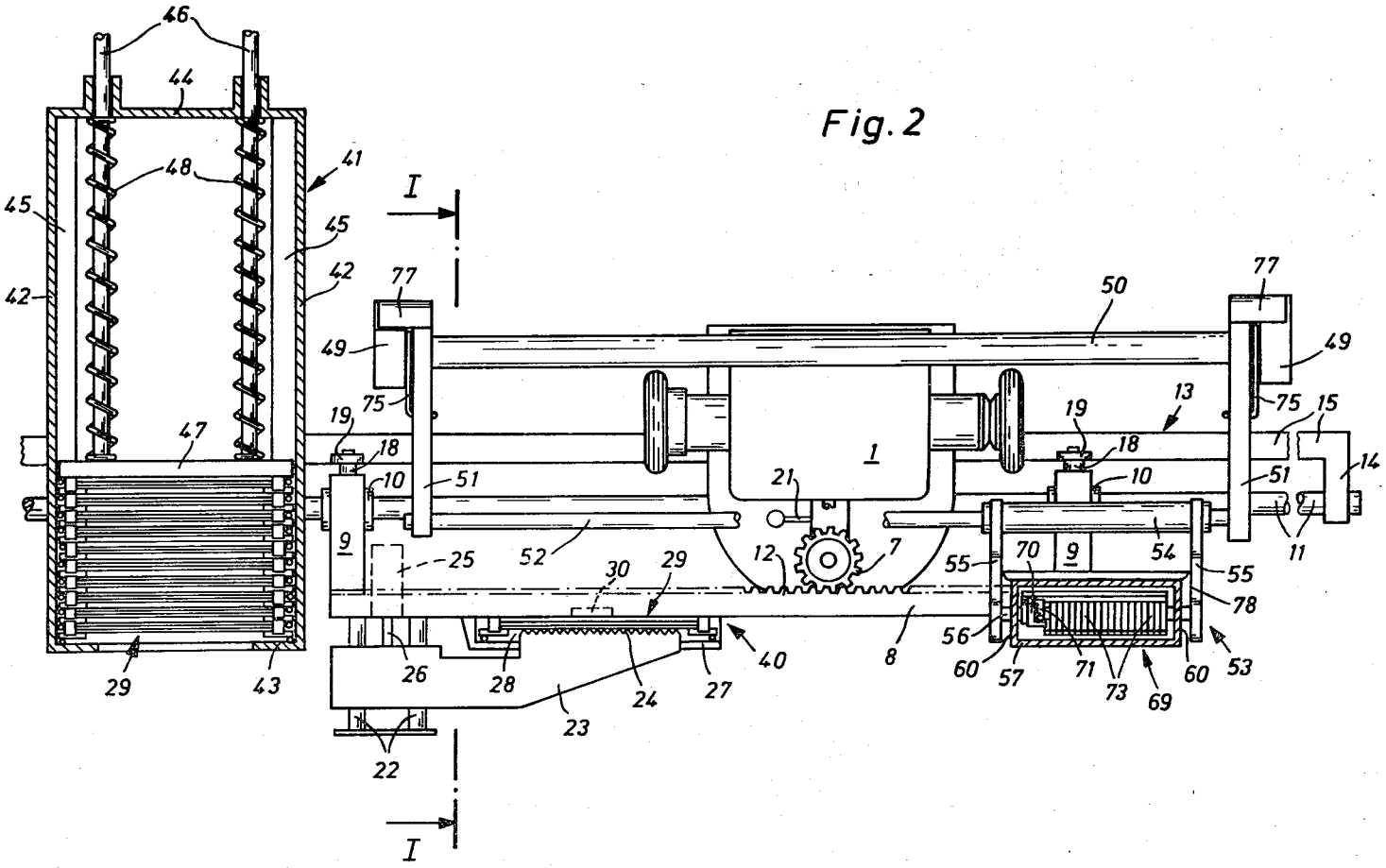
FIG. 2 is a partial top plan and sectional view of the apparatus shown in FIG. 1.
Figure 3:
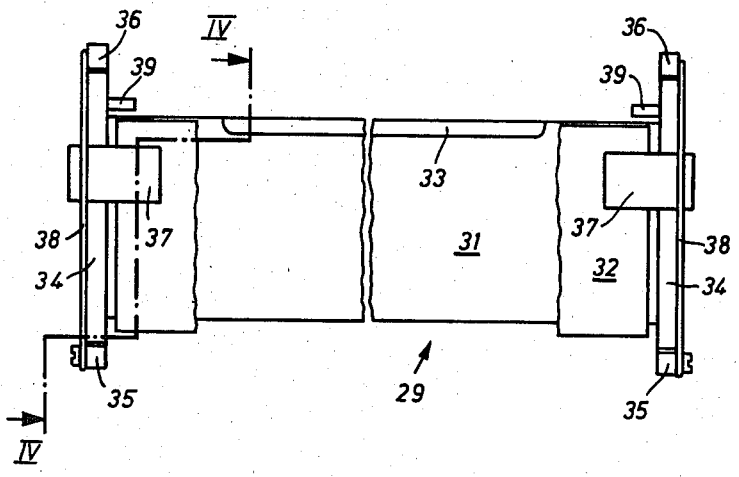
FIG. 3 is a side elevational view of a clamp used in the device of FIG. 1.

As soon as carriage 8 carrying a new clamp 29 is displaced again into its mid-position shown in FIG. 2, gripping tongs 69 holding the let-out fur section B is manually moved into the zone of clamp 29 received in carriage 8, and by pivoting frame 53 downwardly, brought into a position below holding bracket 23. Below holding bracket 23, tongs 69 is pivoted manually clockwise as viewed in FIGS. 1, 6 and 7, about rod 56, so that fur section B is moved upwardly, with the last sewed-on furskin strip A brushing by its fur side along clamping plate 32. In this way, the hairs are deflected downwardly and held away from the edge to be later sewn of strip A. While moving fur section B into position at the new fur skin strip A held fast in clamp 29, the already mentioned backspacing is again observed. As soon as the upper edge of the last strip A sewn to fur section B is aligned with the upper edge of the new strip A received in clamp 29, holding bracket 23 is moved into its clamping position whereupon tongs 69 is opened and moved back into its rest position. A new sewing operation may start.

While specific embodiments of the invention have been shown and described in detail to illustrate the application of the principles of the invention, it will be understood that the invention may be embodied otherwise without departing from such principles.

What is claimed is:

1. An apparatus for use with a sewing machine having a reciprocating needle to sew materials such as furskins into sections at a sewing zone, comprising a carriage mounted alongside said sewing machine and being movable through the sewing zone, drive means connected to said carriage for driving said carriage through the sewing zone, a clamp for clamping material therein in a position for being sewn and positioned on said carriage for movement therewith past the sewing zone for the sewing thereof, and a holding bracket for holding an article section which has already been formed in the vicinity of said clamp carried by said carriage for movement with said carriage through said sewing zone.

2. An apparatus according to claim 1, wherein there are a plurality of clamps in a number corresponding to the number of individual articles to be sewn together including magazine means for holding said clamps in a position that they may be moved one at a time from the magazine and transferred to said carriage.

3. An apparatus according to claim 1, wherein the sewing machine includes a main drive, the drive means including a driving member connected to the main drive of said sewing machine.

4. An apparatus according to claim 1, wherein said clamp comprises a supporting plate and a clamping plate movable relative to said supporting plate about an axis adjacent an end of said supporting plate in the vicinity of the sewing machine needle being positionable in a clamping position to overlie said support plate and being displaced away from said support plate in a direction toward said needle.

5. An apparatus according to claim 1, including gripping tongs, arm means mounting said gripping tongs for movement over said carriage, said tongs being pivotal in a manner such that the last sewn-on article of material is moved upwardly while brushing along said clamping plate and being engaged with the previously formed section of the article to displace it into a position for sewing to the next adjacent article carried by said clamp.

6. An apparatus according to claim 1, wherein said drive means includes a rotatable gear, said carriage having a rack engaged with said gear and means for engaging and disengaging said gear from said rack.

7. An apparatus according to claim 6, wherein said clamp includes a support plate, a side plate on each end of said support plate, a clamping plate overlying said support plate, a leg spring carried by each end post and having an extension piece engageable over each end of said clamping plate and biasing it toward said support plate, said clamping plate being movable against the holding force of said leg spring, said side plates having a pivot pin over which said clamping plate is pivotable at the location above the tops of said support plate and said clamping plate.

8. An apparatus according to claim 7, including a support arm having two pivotal sections including an outer section having a tong pivot thereon, a pair of tongs pivoted on said tong pivot and having clamping ends engageable with the articles to be sewn together, said outer arm being pivotal to position said clamping tongs with the article to be sewn together with the piece held in said clamps, said clamping bracket being movable to clamp the article in said tongs at the sewing station with the articles carried in said clamp.

* * * * *